US007287968B2

(12) United States Patent
Haser et al.

(10) Patent No.: US 7,287,968 B2
(45) Date of Patent: Oct. 30, 2007

(54) PERISTALIC PUMP HAVING HINGED BACKING PLATE

(75) Inventors: Christian Haser, Stahnsdorf (DE); Peter Zentner, Berlin (DE)

(73) Assignee: W.O.M. World of Medicine AG (DE)

( * ) Notice: Subject to any disclaimer, the term of this patent is extended or adjusted under 35 U.S.C. 154(b) by 467 days.

(21) Appl. No.: 10/450,208

(22) PCT Filed: Dec. 10, 2001

(86) PCT No.: PCT/DE01/04725

§ 371 (c)(1),
(2), (4) Date: Jun. 10, 2003

(87) PCT Pub. No.: WO02/48549

PCT Pub. Date: Jun. 20, 2002

(65) Prior Publication Data

US 2004/0037724 A1 Feb. 26, 2004

(30) Foreign Application Priority Data

Dec. 12, 2000 (DE) ..... 100 62 600

(51) Int. Cl.
*F04B 43/12* (2006.01)

(52) U.S. Cl. ..... 417/477.9

(58) Field of Classification Search ..... 417/477.9, 417/476, 477.1, 477.2
See application file for complete search history.

(56) References Cited

U.S. PATENT DOCUMENTS 3,447,478 A 6/1969 Clemens
4,138,205 A 2/1979 Wallach
4,256,442 A * 3/1981 Lamadrid et al. ..... 417/477.11
4,363,609 A * 12/1982 Cosentino et al. ..... 417/477.5
5,230,614 A * 7/1993 Zanger et al. ..... 417/477.9
5,249,937 A * 10/1993 Aubert ..... 417/475
5,324,180 A * 6/1994 Zanger ..... 417/475
5,433,588 A * 7/1995 Monk et al. ..... 417/477.2
5,759,017 A * 6/1998 Patton et al. ..... 417/477.9
5,971,726 A * 10/1999 Yoshida et al. ..... 417/477.1

FOREIGN PATENT DOCUMENTS

| | | |
|---|---|---|
| DE | 1 576 20 | 11/1982 |
| DE | G 83 29 579 | 1/1984 |
| DE | 85 04 221 | 5/1985 |
| FR | 2 594 496 | 8/1987 |
| GB | 1 344 825 | 1/1974 |

* cited by examiner

*Primary Examiner*—Charles G. Freay
(74) *Attorney, Agent, or Firm*—McGlew and Tuttle P.C.

(57) ABSTRACT

A peristaltic hose pump comprising a roller wheel, which can rotate about a roller wheel axis and which has rollers that are mounted on the roller wheel. The rollers roll along a circular path having a certain radius with respect to the roller wheel axis. The peristaltic hose pump also comprises a pressure arched element with a supporting surface, whereby the supporting surface extends along a circular path having a certain radius around the rotation axis of the roller wheel. In addition, a flexible hose can be inserted between the supporting surface and the rollers of the roller wheel.

16 Claims, 4 Drawing Sheets

PERISTALIC PUMP HAVING HINGED BACKING PLATE

SCOPE OF THE INVENTION

Figure 1:
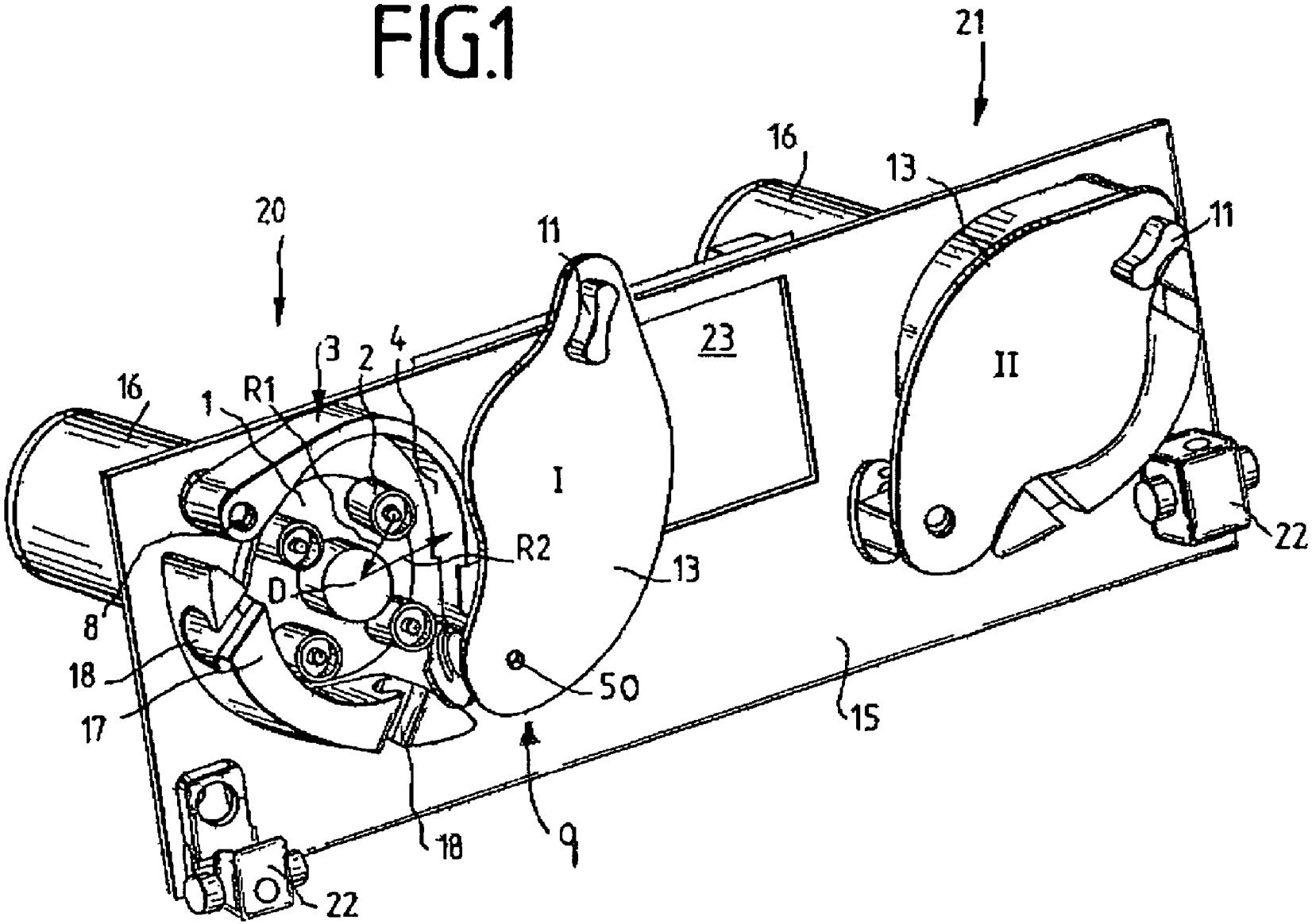

The invention relates to a peristaltic hose pump comprising a roller wheel, which can rotate about a roller wheel axis and which has rollers that are mounted on the roller wheel. The rollers roll along a circular path having a certain radius with respect to the roller wheel axis. The peristaltic hose pump also comprises a pressure arched element with a supporting surface, whereby the supporting surface extends along a circular path having a certain radius around the rotation axis of the roller wheel. In addition, a flexible hose can be inserted between the supporting surface and the rollers of the roller wheel.

STATE OF THE ART

A peristaltic hose pump of the aforementioned design is known from DE-G 83 29 579. Here the pressure arched element is formed by a deformable band, the one end of which is firmly clamped, while its other end is adjustably held in its axial direction, which facilitates the adaptation to different hose diameters. The band made of a metallic material, plastic or fabric has the disadvantage of too high elasticity. Furthermore, the elastic band is stretched over the rollers and respectively runs in a straight fashion between the rollers, so that the liquid swept volume formed within the hose is reduced, so that the volume transported and thus the delivery rate are relatively low.

In order to achieve high pressures and delivery rates with peristaltic hose pumps and to obtain an exact pinching of the hose between the rollers of the roller wheel and the pressure arched element, a peristaltic hose pump incorporating a rigid pressure arched element is known from practice. Here precision hoses with small tolerances are used, and the mechanical parts are manufactured and mounted with high precision. In spite of this, faults occur due to hose tolerances as well as manufacturing and mounting tolerances in the mechanical parts. Because tolerances cannot be completely excluded, they are compensated by means of a spring with which the rigid pressure arched element is pressed against the roller wheel, an arrangement which can, for example, be found on arthroscopic pumps made by the firms Stryker, Arthrex and EMS. The disadvantage here is that the spring force is directional and only provides the hose with a precise impression at that point of the roller that is in the line of the force. At all other points of the roller only a component of the spring force is exerted. Where the force acts 90° to the roller, this component is equal to zero. This leads to an only limited compensation for tolerance. It is not possible to generate high pressures for high delivery rates.

TECHNICAL OBJECTS OF THE INVENTION

The technical object of the invention is thus to provide a peristaltic pump that has an improved delivery pressure and, in particular, that thus also provides an improved delivery rate.

BASIS OF THE INVENTION AND PREFERRED EMBODIMENTS

To solve this problem, the invention provides that the supporting surface is made of an elastically deformable synthetic material, and the pressure arched element is preshaped with the provision that the extension of the supporting surface, when the pressure arched element is not under tension, essentially corresponds to the extension of the supporting surface when under tension. This ensures that the hose is clasped between the roller and the pressure arched element by the same continuous amount in each position of the roller with respect to the pressure arched element. During the circulating movement of the roller wheel, the elastic deformation (prestress) runs with the roller through the pressure arched element, so that the clasping force always acts perpendicular to the roller. This facilitates compensation for greater tolerances in the hose, production and assembly, which results in considerable cost savings in manufacturing the hose pump. Depending on the respective design of the elastically deformable supporting surface of the pressure arched element, the pressures and delivery rate can be increased by at least 50% as compared with a rigid pressure arched element. Delivery rates of more than 2 l/min up to 3 l/min can be accomplished. The unstressed condition corresponds to a mounting position of the pressure arched element in which a hose can be inserted. The stressed condition corresponds to an operating position in which the supporting surface is moved in directions towards the rotation axis of the roller wheel relative to the mounting position, whereby the hose is clasped between the roller rollers and the supporting surface. The pressure arched element is mounted or fixed in the region of its two ends, but other than that it is free, i.e. it is not supported by any other components.

In the state of the art according to DE-G 83 29 579, the elastic band is tensioned over the rollers and runs straight between the rollers, so that the liquid delivery volume within the flexible hose is reduced, so that the volume transported and thus the delivery rate are relatively small. On the other hand, the rigid pressure arched element, which is pressed against the roller wheel by spring action, only presses the hose exactly in the direction of force of the spring in the roller position, so that no high pressures for a high delivery rate are generated. In contrast, the hose pump according to the invention provides that there is sufficient space between two rollers, respectively to transport the liquid, while at the same time high pressures and high delivery rates can be accomplished. The invention thus overcomes the disadvantages inherent in the previously known hose pumps.

In one embodiment the pressure arched element consists of a rigid metallic material and is provided with the supporting surface made of the elastically deformable synthetic material. In a further embodiment the pressure arched element is wholly made of the elastically deformable synthetic material. The synthetic material is preferably white polyoxymethylene (POM). The pressure arched element is thereby made of materials having high elasticity, and can be engineered in such a way that when it closes due to a prestressed inherent deformation, it pinches the hose on the rollers. When the roller wheel moves, the elastic deformation (prestress) runs through the pressure arched element with the roller.

Further advantageous embodiments of the invention are shown in the further subclaims. Reference is hereby particularly made to the tensioning device according to subclaim 8. This device tensions the pressure arched element at the same time that the hose pump is closed, so that the operator is not at risk to get his fingers caught between the rollers and the pressure arched element in its stressed condition.

EXAMPLES OF EMBODIMENTS

Figure 2:
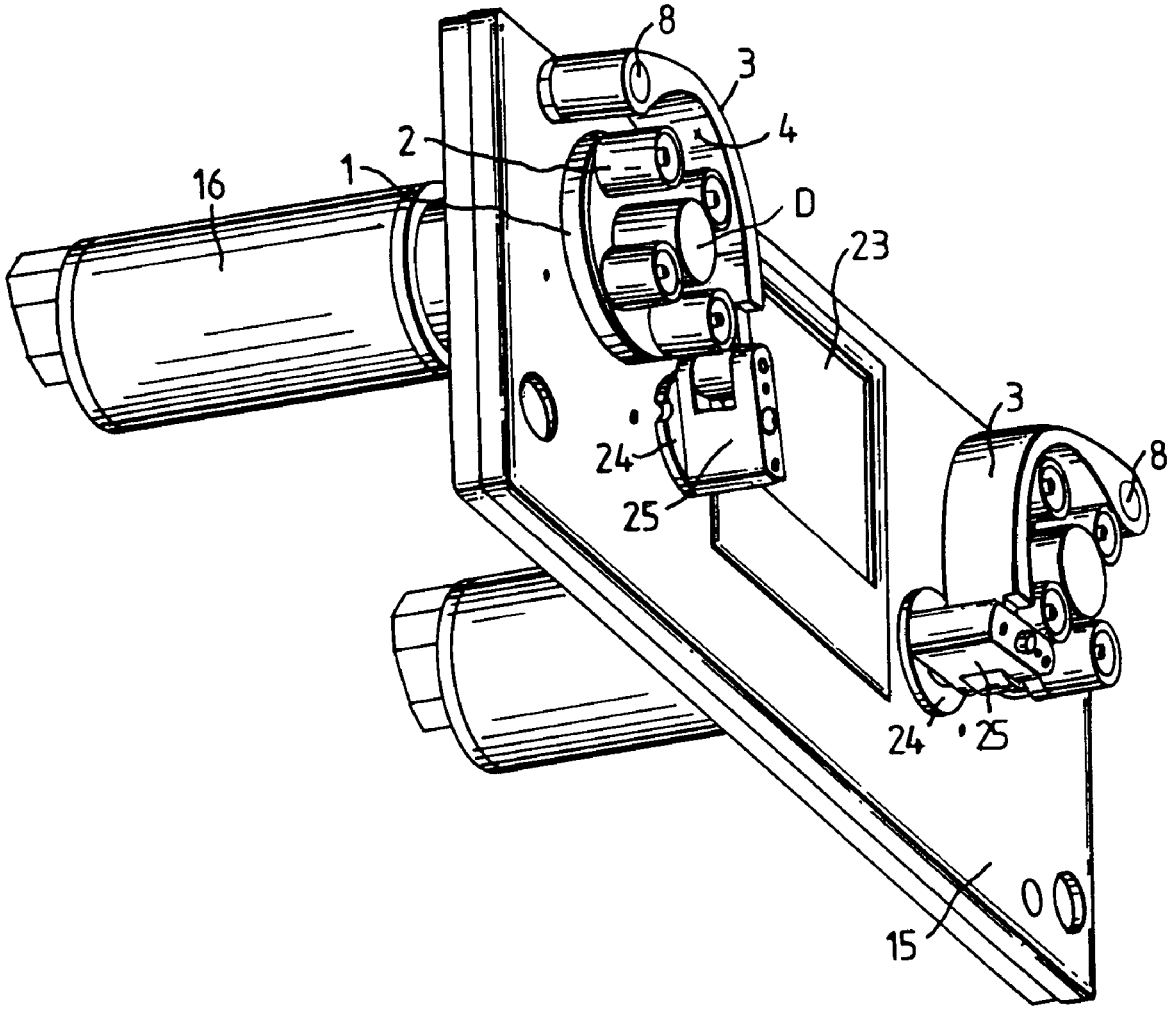
Figure 3:
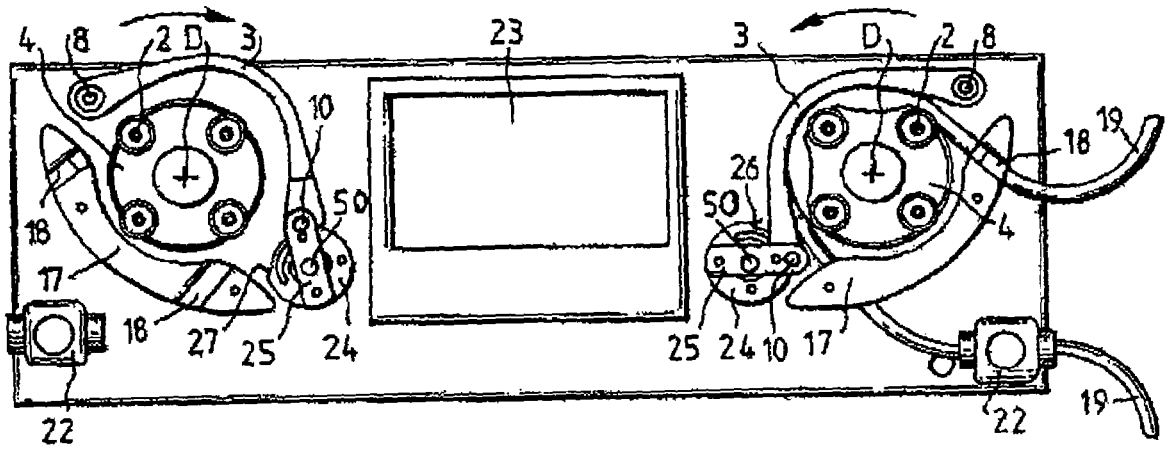
Figure 4:
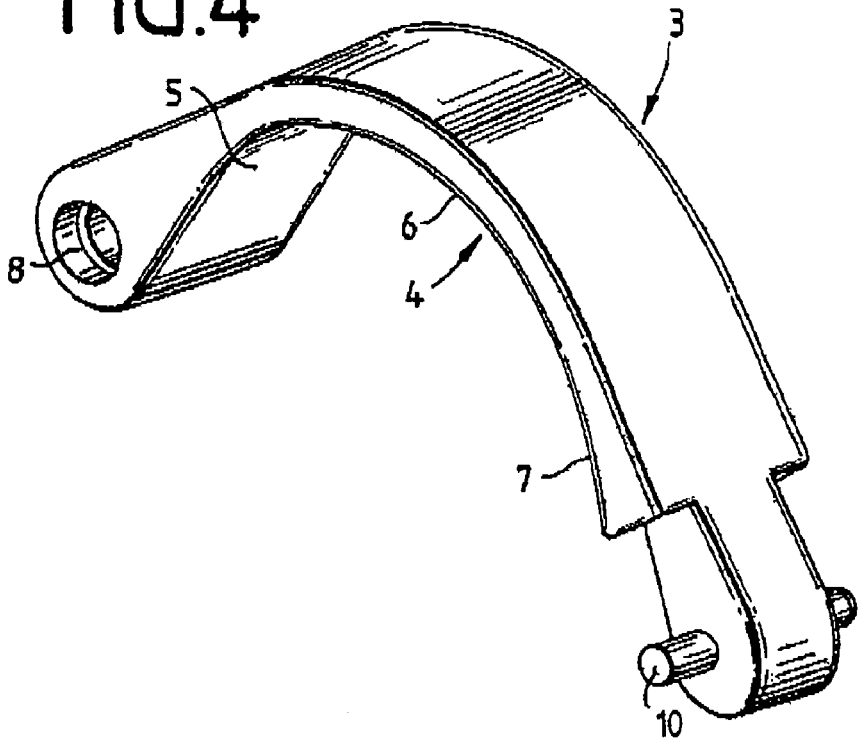
Figure 5:
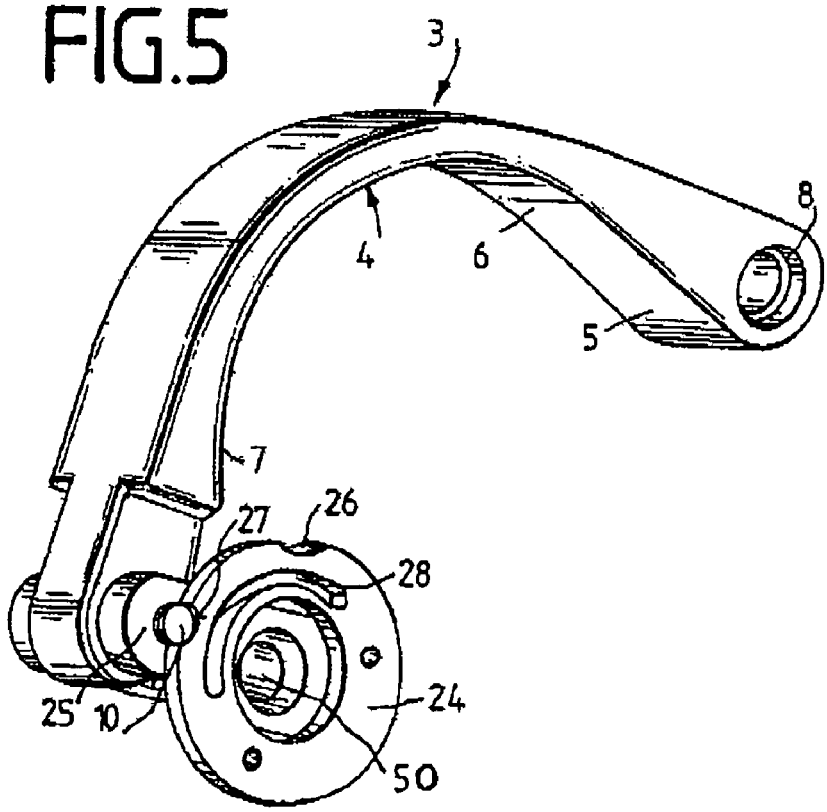

The following examples serve to further explain the invention with the help of the figures shown. The figures represent the following:

FIG. 1: perspective representation of the front plate of the device housing for two peristaltic hose pumps, without inserted flexible hoses, whereby the left hose pump is open and the right hose pump is closed;

FIG. 2: perspective representation of the front plate according to FIG. 1, without the covers for the two hose pumps;

FIG. 3: top view of the representation shown in FIG. 2, with an inserted hose;

FIG. 4: perspective front view of the pressure arched element of a hose pump, and FIG. 5: perspective rear view on to the pressure arched element with clamping disk.

FIGS. 1 through 3 show the front plate 15 of a device housing for two peristaltic hose pumps 20, 21, whose roller wheels 1 are each equipped with four rollers 2 and are driven by electric motors 16 mounted on the rear side of the front plate 15. Assigned to each roller wheel 1 with four rollers 2 there is a pressure arched element 3 with a supporting surface 4 on the side facing the rollers 2, whereby the supporting surface 4 is provided with a run-in zone 5, a middle zone 6 and a run-out zone 7, as detailed in FIG. 4. The pressure arched element 3 is pivotally mounted on a pivot axis 8 arranged on the front plate 15, while on its opposite end it is provided with a dowel pin 10 which on the one hand engages in an adjusting link 25 and, on the other hand, acts in combination with the snatch posts 26, 27 of a clamping disk 24, that is rigidly mounted on the front plate 15. Firmly attached to the adjusting link 25 is a closing plate 13, which can be pivoted by means of an actuating element 11 that is attached to it.

The rollers 2 of the peristaltic hose pumps 20, 21 roll along a circular path having a radius R1 with respect to the rotation axis D of the roller wheel 1 along the supporting surface 4 of the pressure arched element 3, whereby the supporting surface 4 extends along a circular path having a radius R2 around the rotation axis D of the roller wheel 1, and whereby a flexible hose 19 can be inserted between the supporting surface 4 and the rollers 2 of the roller wheel 1. In the embodiment shown, the pressure arched element 3 and the supporting surface 4 are made in one piece and of an elastically deformable synthetic material. In another embodiment not shown here, the pressure arched element 3 can also be made of a metallic material and be provided with an inner-lying lining made of synthetic material, which then forms the supporting surface 4. The pressure arched element 3 is preshaped with the provision that the extension of the supporting surface 4 when not under tension essentially corresponds to the extension of the supporting surface 4 when under tension.

The preferred synthetic material used is polyoxymethylene (POM). Preferably Delrin, manufactured by Dupont, or Hostaform, manufactured by Hoechst are used. The preferred modulus of elasticity in tension is ≧3000 MPa (megapascal). The bending fatigue strength is preferably ≧30 MPa. The impact strength at a room temperature of 23° C. is preferably ≧130 KJ/$m^2$ (kilojoules per square meter). The coefficient of sliding friction against steel for a dry run is preferably ≧0.30. In tests that were conducted, a POM synthetic material with these characteristics proved particularly suitable for the supporting surface 4 of the pressure arched element 3 of the hose pumps 20, 21.

Opposing the pressure arched element 4 of each hose pump 20, 21 is a bracket 17 firmly mounted on the front plate 15 and having two passage openings 18 to insert a flexible hose 19 that is respectively arranged tangentially to the roller wheel 1 and comes to rest on the supporting surface 4 on the inner side of the pressure arched element 3.

The pressure arched element 4 is provided with a run-in zone 5, a middle zone 6 and a run-out zone 7, whereby the pressure arched element 3 has—at least in the run-out zone 7, and preferably also in the run-in zone 5—a larger cross section as compared with the middle zone 6, preferably an increased thickness in directions orthogonal to the supporting surface. With respect tote rotation axis D of roller wheel 1, the middlezone 6 extends across an angle of 10 to 90°, preferably 20 to 60°, with respect to the embracing of the roller wheel 1 by the hose 19. With respect to the rotation axis D, the pressure arched element 3 extends across an angle of 90 to 180°, preferably 120 to 170".

The pressure arched element 3, which is rigidly arranged on the front plate 15 and mounted on the pivot axis 8 parallel to the rotation axis D of the roller wheel 1, is, at its other end, pivotally mounted between a mounting point I for the hose 19 and an operating point II for the hose by means of a fixation device 9. For this purpose, the fixation device 9 comprises a dowel pin 10 located at the second end of pressure arched element 3, as well as a closing plate 13 with an actuating element 11, which is rotatably mounted around a tension rotation axis S running parallel to the rotation axis D of the roller wheel 1. When swinging the closing plate 13 over from the mounting position I of the hose 19 (in FIG. 1, left hose pump 20) into the operating position II (in FIG. 1, right hose pump 21), the dowel pin 10 is moved from the one snatch post 26 of the clamping disk 24 to its other snatch post 27, whereby the clamping disk 24 is embodied in a springy manner by an arc-shaped slit 28 running between the two snatch posts 26, 27. In the operating condition II, the closing plate 13 facially covers the roller wheel 1 as well as the inserted hose 19, and thus fixes the hose 19 in the direction of the rotation axis D of the roller wheel 1. In the operating condition II, the closing plate 13 can be positively engaged in place. The roller wheel 1 and/or the pressure arched element 3 are interchangeable.

In FIG. 1, radius R1 to the hose pump 20 is defined as the rolling radius of the outside of each roller 2 with respect to the rotation axis D of the roller wheel 1, and radius R2 is defined as the distance between the supporting surface 4 from the middle axis D of the roller wheel 1. With respect to their radial difference R2−R1, the roller wheel 1 and/or the pressure arched element 3 can be selected with the stipulation that a prescribed hose with a wall thickness of <R2−R1/2 is usable.

The peristaltic hose pumps 20, 21 shown, form an arthroscopic pump in which the hose pump 20 shown on the left in FIG. 1 forms the suction side, and the hose pump 21 shown on the right in FIG. 1 forms the flushing side. The hose pump 20 on the suction side rotates clockwise while the hose pump 21 on the flushing side rotates counter clockwise. Mounts 22 for the hose 19 are provided for both hose pumps 20, 21. The mounts 22 incorporate pressure sensors. Between both hose pumps 20, 21, the front plate 15 has a window 23 for a display showing the values for pressure, delivery rate and similar functions of the arthroscopic pump.

In an alternative embodiment the pressure arched element 3 has, at least in the middle zone 6, a slit-formed recess that extends along a circular path around the rotation axis D of the roller wheel 1.

The invention claimed is:

1. A peristaltic hose pump comprising:

a roller wheel which can rotate about a roller wheel axis D and which has rollers that are mounted on said roller wheel, wherein said rollers roll along a circular path having a radius R1 with respect to said roller wheel axis D;

a pressure arched element with a supporting surface, wherein said supporting surface extends along a circular path defining an extension having a radius R2 around said rotation axis D of said roller wheel;

a flexible hose inserted between said supporting surface and said rollers of said roller wheel, said supporting surface being made of an elastically deformable synthetic material, said pressure arched element being pre-shaped such that said extension of said supporting surface, when said pressure arched element is not under tension, essentially corresponds to said extension of said supporting surface when under tension, wherein a fixation device comprises a dowel pin located at an end of said pressure arched element and a closing plate, said closing plate being rotatably mounted around a tension rotation axis running parallel to said rotation axis D of said roller wheel, whereby said closing plate interacts with said dowel pin such that said dowel pin leaves a first snatch post and is pressed into a second snatch post of a clamping disk when said closing plate is turned from a hose mounting position to an operating position.

2. A peristaltic hose pump according to claim 1, wherein said synthetic material is polyoxymethylene (POM).

3. A peristaltic hose pump according to claim 1, wherein said synthetic material has a modulus of elasticity in tension of ≧1000 MPa (megapascal), a bending fatigue strength of ≧10 MPa, and an impact strength at a room temperature of 23° C. of ≧70 KJ/m$^2$ (kilojoules per square meter).

4. A peristaltic hose pump according to claim 3, wherein said synthetic material has a modulus of elasticity in tension of ≧3000 MPa (megapascal), a bending fatigue strength of ≧30 MPa, and an impact strength at a room temperature of 23° C. of ≧130 KJ/m$^2$ (kilojoules per square meter).

5. A peristaltic hose pump according to claim 1, wherein said pressure arched element has a run-in zone, a middle zone and a run-out zone, whereby at least said run-out zone has a larger cross section as compared with said middle zone.

6. A peristaltic hose pump according to claim 5, wherein said run-in zone also has a larger cross section as compared with said middle zone, an increased thickness in directions orthogonal to said supporting surface.

7. A peristaltic hose pump according to claim 1, wherein a middle zone extends across an angle of 10° to 90° an embracing of said roller wheel by said hose and with respect to said roller wheel axis D, said pressure-arched element extends across an angle of 90° to 180°.

8. A peristaltic hose pump according to claim 1, wherein, with respect to said rotation axis D, said pressure arched element extends across an angle of 90° to 180°.

9. A peristaltic hose pump according to claim 1, wherein said pressure arched element is at its first end mounted on a pivot axis rigidly arranged on a hose pump and running parallel to said rotation axis D of said roller wheel, and at its second end by a pivoting means of a fixation device so that it can pivot between a hose mounting point and an operating point.

10. A peristaltic hose pump according to claim 1, wherein, in an operating position, a closing plate facially covers said roller wheel as well as said hose placed around it, in such a way that said hose is fixed in the direction of said rotation axis D of said roller wheel.

11. A peristaltic hose pump according to claim 1, wherein, in an operating position, a closing plate is positively engaged in place.

12. A peristaltic hose pump according to claim 1, wherein said roller wheel and said pressure arched element are replaceable.

13. A peristaltic hose pump according to claim 1, wherein, with respect to their radial difference R2−R1, said roller wheel and said pressure arched element can be selected with the stipulation that in mounting position a prescribed hose with an outer diameter of less than R2−R1 can be inserted.

14. A peristaltic hose pump according to claim 1, wherein, with respect to their radial difference R2−R1, said roller wheel and said pressure arched element can be selected with the stipulation that a prescribed hose with a wall thickness of <(R2−R1)/2 can be inserted.

15. A peristaltic hose pump comprising:

a roller wheel rotating about a roller wheel axis D and having rollers mounted on said roller wheel, wherein said rollers roll along a circular path having a radius R1 with respect to said roller wheel axis D;

a pressure arched element with a supporting surface, whereby said supporting surface extends along a circular path having a radius R2 with respect to said roller wheel axis D; and a closing plate rotatably mounted around a tension rotation axis S running parallel to said roller wheel axis D and having a mounting position and an operating position, wherein a flexible hose is inserted between said supporting surface and said rollers, wherein said supporting surface is made of an elastically deformable synthetic material, and said pressure arched element is pre-shaped with the provision that an extension of said supporting surface, when said pressure arched element is not under tension, essentially corresponds to said extension of said supporting surface when under tension.

16. A peristaltic hose pump comprising:

a selective pressure inducing guide for a flexible hose defined by an inner guide means including a roller wheel with a circular perimeter rotating about an axis D having a plurality of rollers, each of said rollers mounted near the outer edge of said circular perimeter to rotate about its own axis, said plurality of rollers combining to form an inner circular path with an annular radius R1 with respect to said axis D for said flexible hose;

an outer guide means including a pre-shaped pressure arched element with a flexible supporting surface extending to form an outer circular path with an annular radius R2 with respect to said axis D for said flexible hose; and a closing plate rotatably mounted around a tension rotation axis S running parallel to said roller wheel axis D and having a mounting position and an operating position, wherein said closing plate includes an actuating means which can be actuated to close said closing plate by hand and said supporting surface, made of an elastically deformable synthetic material, retains its shape when tension is applied by said flexible hose inserted between said inner guide means and said outer guide means with said closing plate in said operating position.

* * * * *